US008931831B2

(12) United States Patent
Bassenian

(10) Patent No.: US 8,931,831 B2
(45) Date of Patent: Jan. 13, 2015

(54) BEACH CHAIR

(71) Applicant: Gregory Bassenian, Santa Monica, CA (US)

(72) Inventor: Gregory Bassenian, Santa Monica, CA (US)

( * ) Notice: Subject to any disclaimer, the term of this patent is extended or adjusted under 35 U.S.C. 154(b) by 36 days.

(21) Appl. No.: 13/789,352

(22) Filed: Mar. 7, 2013

(65) Prior Publication Data

US 2014/0252831 A1 Sep. 11, 2014

(51) Int. Cl.

| | |
|---|---|
| ***A47C 4/00*** | (2006.01) |
| ***A47C 1/14*** | (2006.01) |
| ***A47C 7/02*** | (2006.01) |

(52) U.S. Cl.

CPC ..... *A47C 1/146* (2013.01); *A47C 7/022* (2013.01)

USPC ..... 297/16.2

(58) Field of Classification Search

USPC ..... 297/16.2, 352, 451.4, 463.2, 217.6, 297/16.1, 17, 353; 5/419; 248/530, 533, 248/545, 501, 532

See application file for complete search history.

(56) References Cited

U.S. PATENT DOCUMENTS

| | | | | | |
|---|---|---|---|---|---|
| 1,660,494 | A | * | 2/1928 | Robertson | 297/377 |
| 3,422,938 | A | * | 1/1969 | Worcester | 190/8 |
| 3,441,314 | A | * | 4/1969 | Duffield | 297/377 |
| 3,639,001 | A | * | 2/1972 | Anderson | 297/451.1 |
| 4,869,553 | A | * | 9/1989 | Powell | 297/377 |
| 5,688,023 | A | * | 11/1997 | Blocker, Jr. | 297/188.2 |
| 6,015,190 | A | * | 1/2000 | Wend | 297/378.1 |
| 7,178,875 | B2 | * | 2/2007 | Laske, Jr. | 297/452.33 |
| 7,758,119 | B1 | * | 7/2010 | Baterdouk | 297/230.1 |

FOREIGN PATENT DOCUMENTS

CN 201509906 U * 6/2010

* cited by examiner

*Primary Examiner* — Milton Nelson, Jr.

(74) *Attorney, Agent, or Firm* — Cislo & Thomas, LLP

(57) ABSTRACT

A lightweight, compact foldable beach chair is presented. The present invention beach chair features an upper seatback portion and a lower sand engagement portion. The seatback portion forms the backrest of the chair and the sand engagement portion anchors the chair in sand. The beach sand itself serves as the seat support for a user. The seatback and sand engagement portions are interconnected by a hub such that the seatback portion and sand engagement portion can rotate about the hub from an open, ready for use position, to a closed position for carrying. The new beach chair includes a detent system such that the seatback and sand engagement portions lock together when in the open and closed positions.

8 Claims, 8 Drawing Sheets

BEACH CHAIR

BACKGROUND OF THE INVENTION

1. Field of the Invention

The present invention relates generally to the field of heath chairs, and in particular to a lightweight, durable and foldable beach chair.

2. Background of the Invention

Folding beach chairs are well known in the art. Typical beach chairs are foldable "lounge" style chairs which include hack and seat support frames which typically comprise assemblies of tubular metal rods. Upon, the back and seat support frames are mounted flexible hack and seat supports, which typically comprise a mesh of flexible fabric bands. The back and seat support frames are generally hinged such that the chairs can be folded for carrying and unfolded for use.

A variety of folding beach chair designs using the general construction described above have been manufactured. Most such designs suffer from certain common drawbacks. In particular, because the chairs need to be lightweight in order to allow for easy transportation to and from, typically, a user's vehicle and the beach, the tubular metal rods used to form the frames are made relatively thin to reduce weight and are therefore relatively weak, bend easily, and generally cannot withstand rough handling. The tubes used to make the frames of prior art beach chairs are frequently made of steel and consequently tend to rust over time, which leads to jamming of the folding mechanism and degradation of the device as a whole.

The hinged joints of typical prior art beach chairs are also an area of weakness. The joints typically comprise pins through holes in the tubular members which form the frames. With repeated folding and unfolding and repeated loading with the weight of an occupant. The holes become elongated around the pins and thus become loose over time. The use of pins through holes in tubular members also makes prior art beach chairs highly susceptible to becoming jammed with sand which causes further impairment, and often complete impairment, to the folding function. The hollow, tubular members of prior an beach chairs also become a repository for sand, and when the chair is brought inside a car or home, sand then is carried into that location, often spilling out of the chair onto the floor. The use of a large number moving parts in prior art chairs also leads to a rapid breakdown of the chair and the folding mechanism, often to the point of non-usability.

The mesh of fabric bands which form the seating supports and backrest supports of prior art beach chairs is another area of weakness. These supports typically tend to stretch and sag and lose their resiliency over time after repeatedly be loaded with a user's weight. As the fabric bands which form the supports stretch and sag, the chairs become uncomfortable. The seat fabric is also susceptible to becoming degraded and moldy due to repeated exposure to not only the elements but also moisture after a user has come back from swimming in the ocean and sits in the chair.

When using a foldable prior art beach chair, the user may only remain in the seated position. Therefore, if a user chooses to lie down in the sand, they must set out a separate towel in a separate space, causing the user to have to get up and move in order to lie down. The heat of the sun may also cause metallic components of a prior art beach chair to heat up to temperatures that are uncomfortable to a user. Due to their inherent deficiencies, prior art folding beach chairs tend to be disposed of by consumers after a relatively short period of time.

In view of the aforementioned deficiencies in typical prior art beach chairs, there is a need for a new type of folding beach chair that dispenses with the rod and fabric band style of construction, typical of the prior art. Such a new chair design should be comfortable, lightweight and foldable, yet also durable and able to withstand rough handling.

SUMMARY OF THE INVENTION

The present invention solves the problems of prior art beach chairs by providing a beach chair of an entirely new design that dispenses with the tubular rod frame and fabric mesh designs of the past and their inherent weaknesses. The present invention beach chair features an upper seatback portion and a lower sand engagement portion. The seatback portion forms the backrest of the chair. The sand engagement portion anchors the beach chair in the sand. The beach sand itself serves as the seat support for a user. In use, after anchoring the seatback in the sand, a user sits on the sand and leans his back against the seatback portion.

The seatback and sand engagement portions are interconnected by a hub such that the seatback portion and sand engagement portion can rotate about the hub from an open, ready for use position, to a closed position for carrying. The new beach chair includes a detent system such that the seatback and sand engagement portions lock together when in the open and closed positions.

The seatback portion has a forward face (i.e. a face that engages a user's back) that is contoured inwardly in a generally concave manner so as to conform to the shape of a users back. The inward curvature of the seatback provides substantial comfort to a user without the need for the flexible band type of back support of the prior art. The upper most edge of the seatback portion has an inwardly curving and rolled surface that cups a user's neck and head and holds them in a comfortable and ergonomic position. On the backside of the seatback portion, the rolled surface at the upper edge, rolls over the backside to form a carrying handle for the beach chair when the seatback and sand engagement portions are in the folded position.

The sand engagement portion of the present invention each chair features a scalloped area that eases engagement of the sand engagement portion with the sand. This feature is particularly desirable on beaches which have hard packed sand. Another desirable feature of the present invention beach chair is the hollow hub design. The hollow hub design, in addition to allowing the seatback and sand engagement portions of the beach chair to rotate with respect to one another, also allows a user to drive the sand engagement portion into the sand with his foot. The hollow hub may also serve as a convenient means for carrying a beach towel. The beach chair of the present invention may also be equipped with optional features such as art array of LED (or other type) of lights on the backside of the seat back portion.

The beach chair of the present invention has several advantages over those of the prior art. For example, the present invention each chair allows a user sit up or lie down in the same location without having to set up a towel in a different location. Due to its construction of plastic, the new beach chair can be washed easily with water without sustaining damage due to rust or other types of corrosion. Due to the plastic materials used in the exemplary embodiment of the new beach chair, it will not heat up in the sun like metal chairs. Due to the new chair's minimal use of moving parts, it is less likely to degrade due to wear over time.

Other features and advantages of the present invention will become apparent with reference to the following detailed description and accompanying drawings.

DETAILED DESCRIPTION OF THE PREFERRED EMBODIMENTS

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Figure 1:
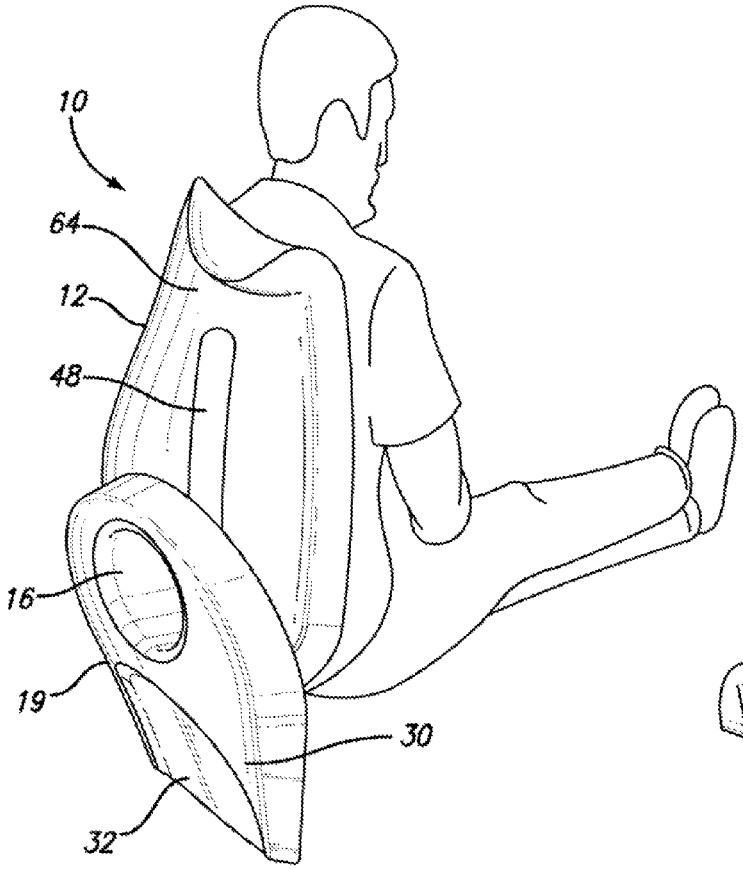
FIG. 1 is a perspective view of the beach chair of the present invention, shown in use, on a beach.
Figure 2:
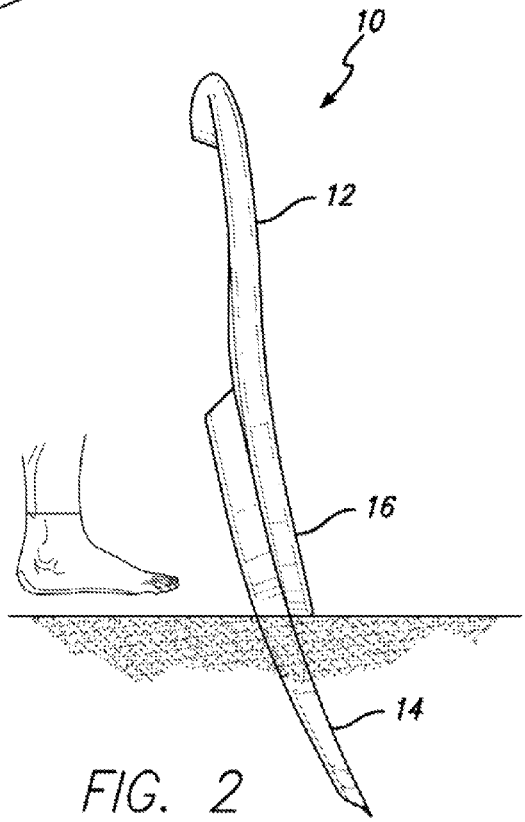
FIG. 2 is a side view of the beach chair of FIG. 1, showing a lower portion of the chair embedded in sand.

Referring now to FIGS. 1-2, the beach chair of the present invention 10 comprises a seatback portion 12 and a sand engagement portion 14. The seatback portion 12 and sand engagement portions 14 are interconnected by a hub 16. The seatback and sand engagement portions are, rotatable about the hub 16 between an open position and a closed position. (FIG. 6 shows the beach chair 10 in the closed position.)

In use, the sand engagement portion 12 is driven into the sand, by a user. Once placed, the user may sit on the sand and lean his or her back against the seatback portion 12 of the beach chair 10. The hub 16 is hollow, which allows a user to use his foot to assist in anchoring the sand engagement portion 14 at least partially below the plane of the sand, i.e. in the sand. The hollow hub 16 also provides a convenient means for carrying a beach towel, i.e. the towel can rolled up and pulled about half-way through the hub, or an unrolled towel can simply pulled about half-way through the hub.

Figure 5:
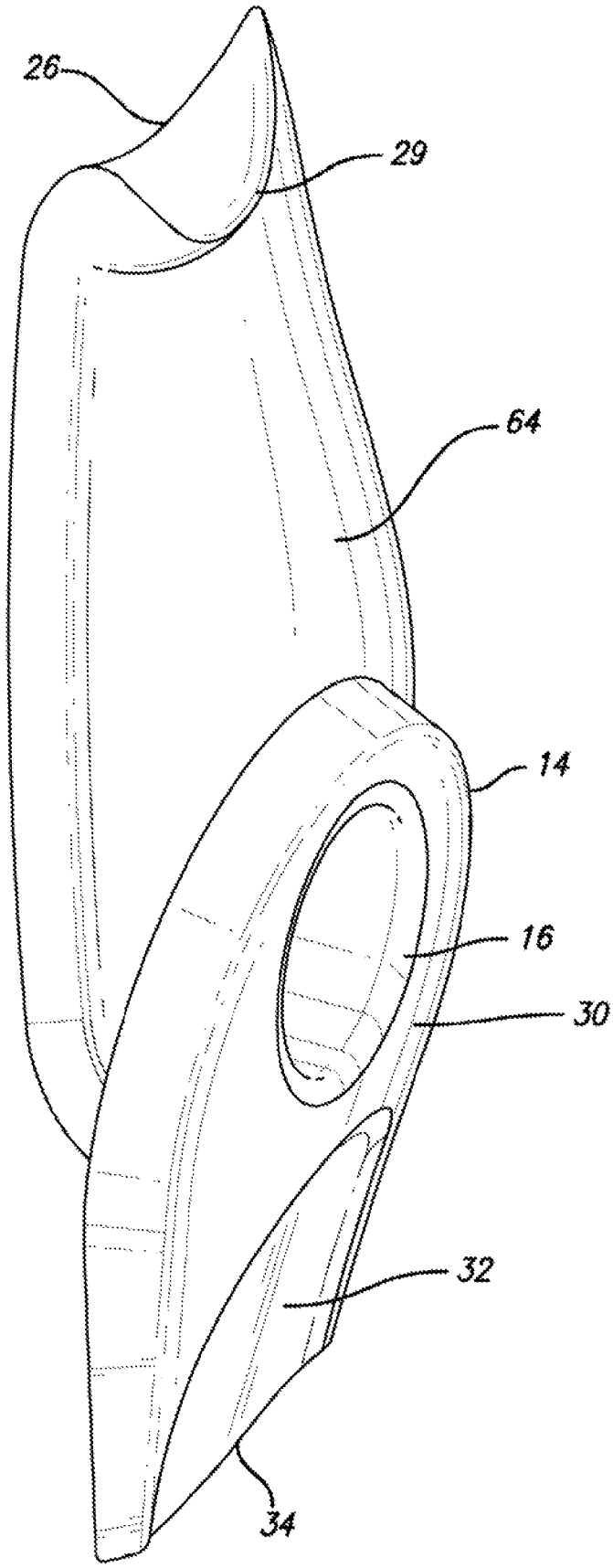
FIG. 5 is a rear facing perspective view of the beach chair of FIG. 1, showing the chair in its deployed position.
Figure 6:
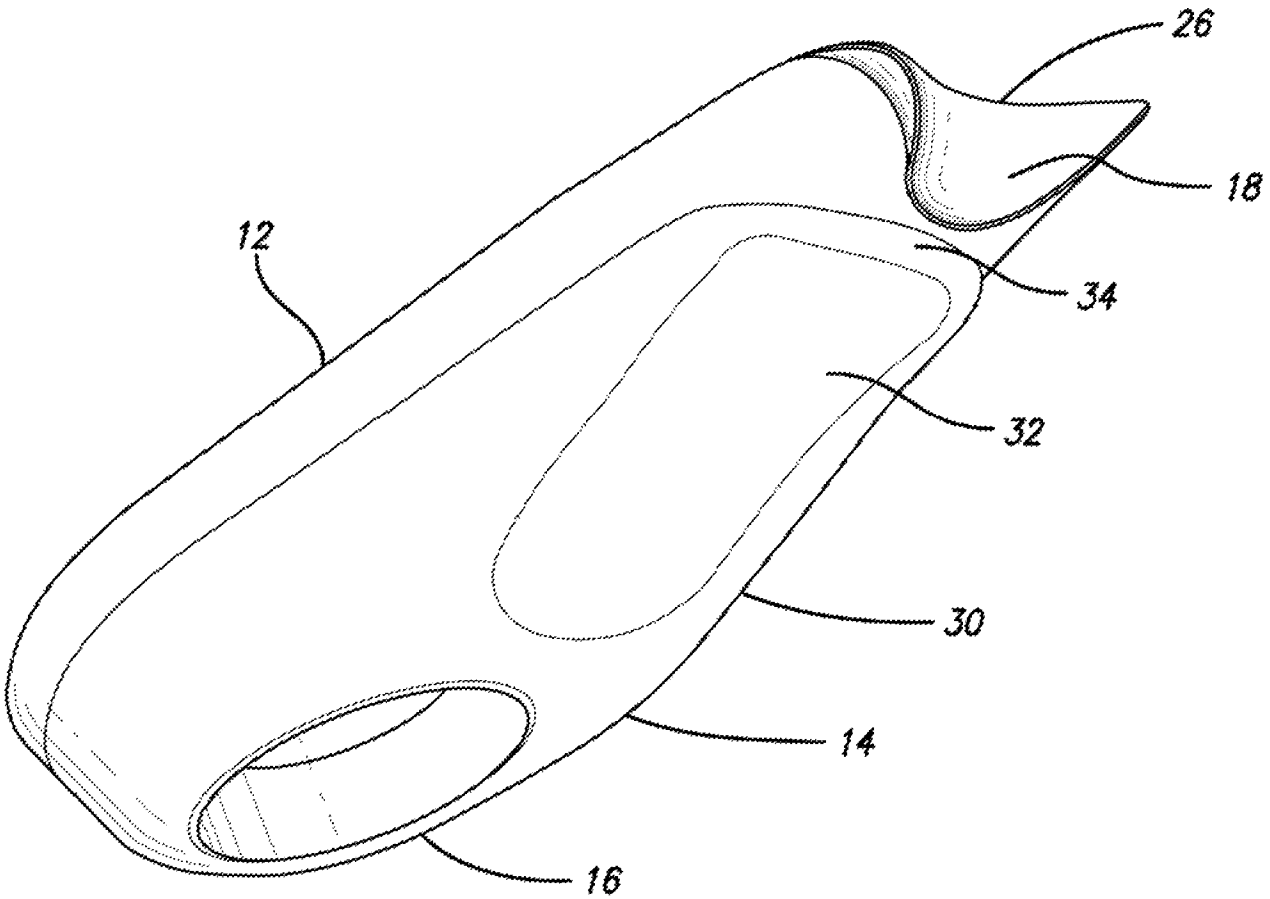
FIG. 6 is a rear facing perspective view of the beach chair of FIG. 1, showing the chair in its closed position.

Referring now to FIGS. 3-6, the seatback portion 12 of the beach chair 10 features an inwardly curving or convex front side 28. The inwardly curving front side 28 is shaped to generally conform to a user's back and therefore provides substantial comfort to a sitting user for long periods of time. The seatback 12 also features an inwardly curved upper edge portion 26. The inwardly curved upper edge portion 26 serves to cup and cradle a user's neck and head in a comfortable, ergonomic position. With particular reference to FIGS. 5 and 6, the upper edge portion 26 rolls over the back of the seatback 12 to create a handle portion 29. The handle portion 29 allows for easy carrying of the present invention beach chair 10, when in the closed position. (See FIG. 6.)

Referring now to FIGS. 5 and 6, the sand engagement portion 14 of the beach chair 10 functions like a shovel blade in the sense that it is intended to be driven into the sand, which allows it to support the seatback 12. The sand engagement portion 12 has an inwardly curving or concave front side 31 and a backside 30. The back side 30 features a scalloped area 32. The scalloped area forms an edge 34 on the sand engagement portion 12. The edge 34 and the scalloped portion 32, aid in anchoring the seatback 14 in hard packed sand. As discussed, the hollow hub 16 also assists in anchoring the sand engagement portion 14 in sand because it allows a user to place his or her foot in the hollow of the hub 16 and thereby drive the sand engagement portion 14 into the sand, like a shovel blade.

Figure 3:
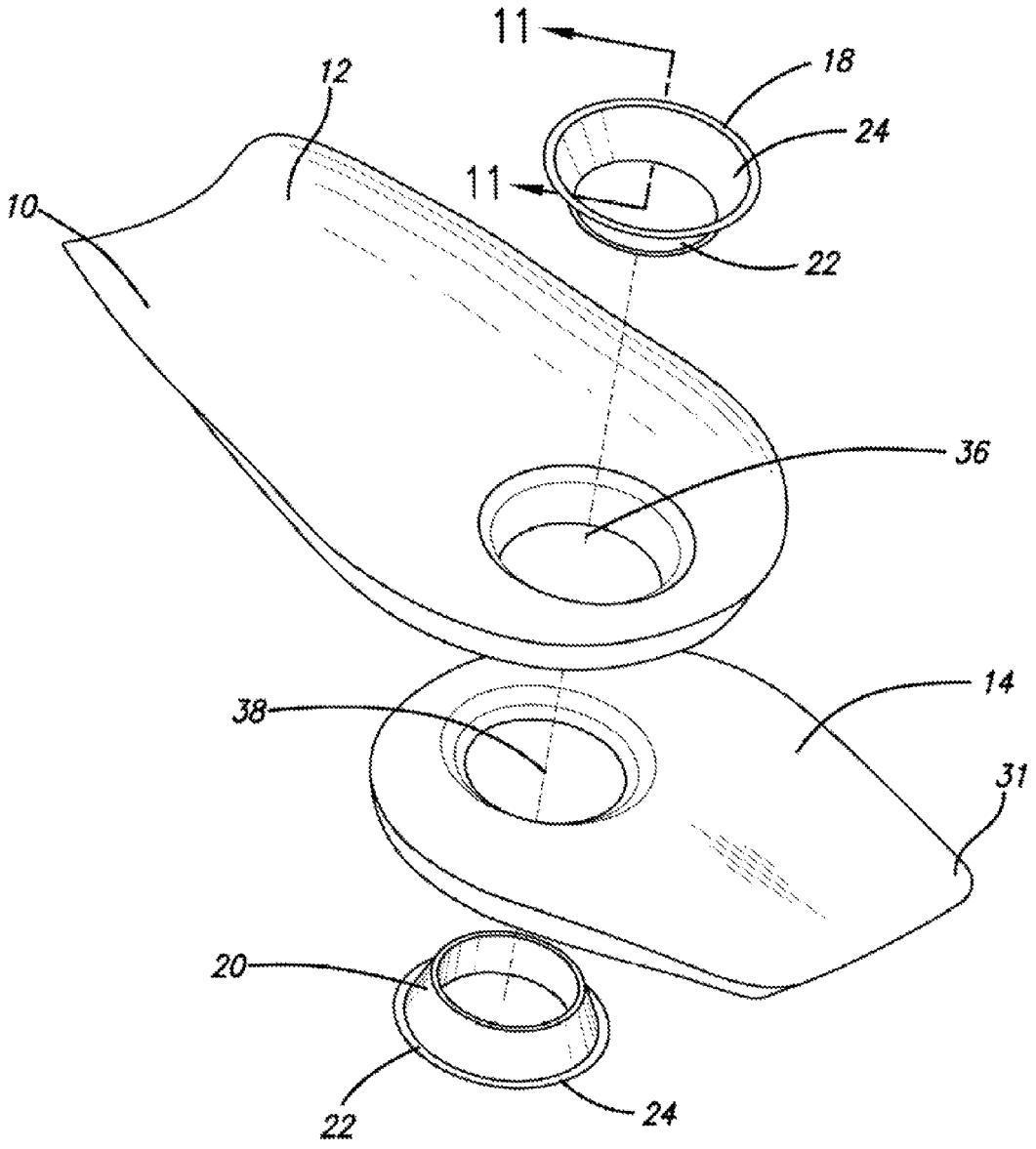
FIG. 3 is an exploded perspective view of the beach chair of FIG. 1.
Figure 4:
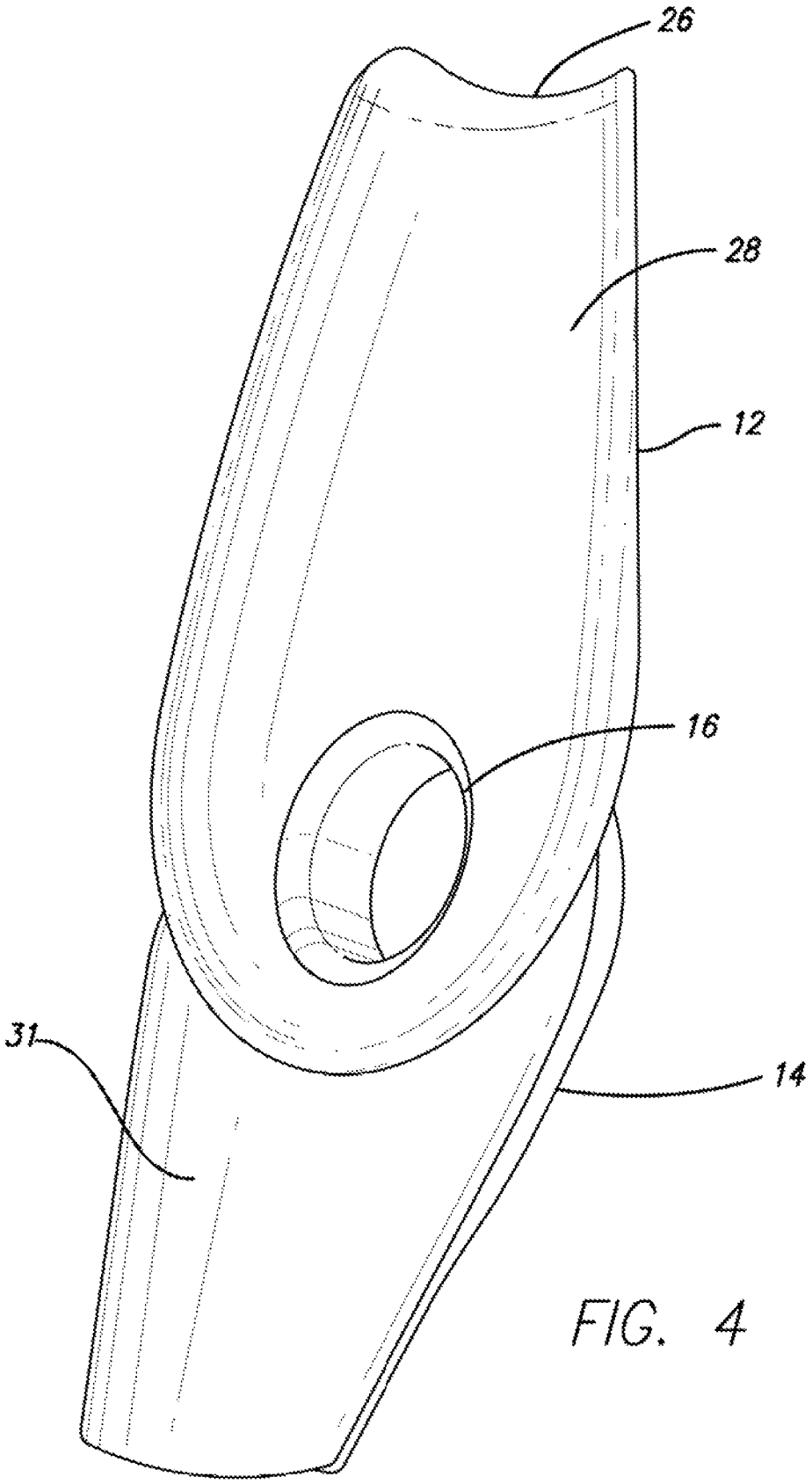
FIG. 4 is a front facing perspective view of the beach chair of FIG. 1, showing the chair in its deployed position.

Referring now to FIG. 3, the hub 16 is comprised of a first hub ring 18 and a second hub ring 20. The first and second hub rings 18 and 20 have upper, circular edges 24 and lower circular edges 22. The first hub ring 18 is configured to mate with a corresponding circular opening 36 in the seatback portion 12, and the second hub ring 20 is configured to mate with a corresponding circular opening in the sand engaging portion 14. The first and second hub rings 18 and 20 are placed within their respective openings 36 and 38 in the seatback and sand engaging portions 12 and 14.

Figure 11:
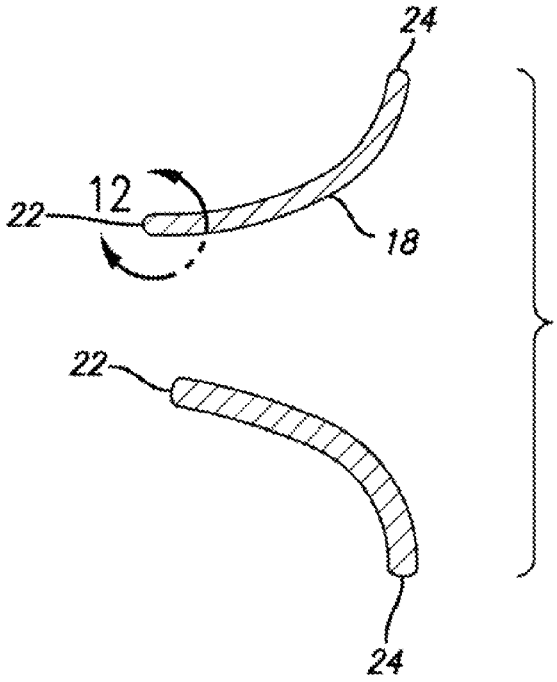
FIG. 11 is a section view taken along the line 11-11 of FIG. 3.
Figure 12:
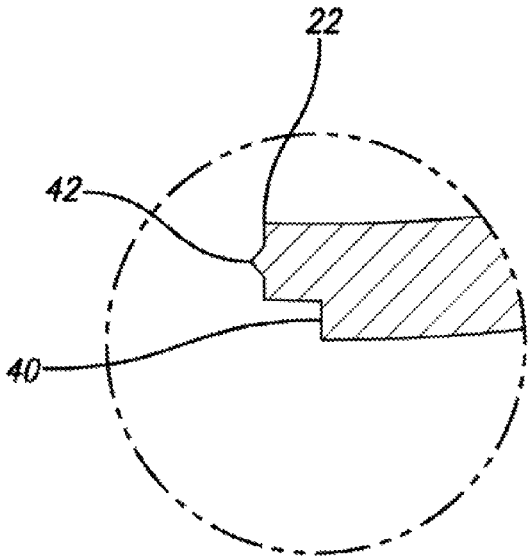
FIG. 12 is a detail of a portion of the section view of FIG. 11, of the area shown by circle 12.

With reference to FIGS. 3 and 11-12, in the exemplary embodiment, the first and second hub rings 18 and 20 are made from ABS plastic and are fused together at their lower circular edges 22 by means of ultrasonic welding. As shown in FIG. 12, the lower circular edges 22 of the first and second hub rings feature a circular v-shaped ridge 42 and a step 40 formed into the ring. These features, and in particular, the v-shaped ridge 42 serve to ensure that the ABS plastic melts during the ultrasonic welding process to create a strong joint between first and second rings 18 and 20. The fused rings, 18 and 20, together form the hub 16. Those of skill in the art will understand that alternative methods of construction of the present invention beach chair are possible. For example, at least one of the hub rings could be formed as an integral part of either the seatback 12 or the sand engagement portion 14.

Figure 7:
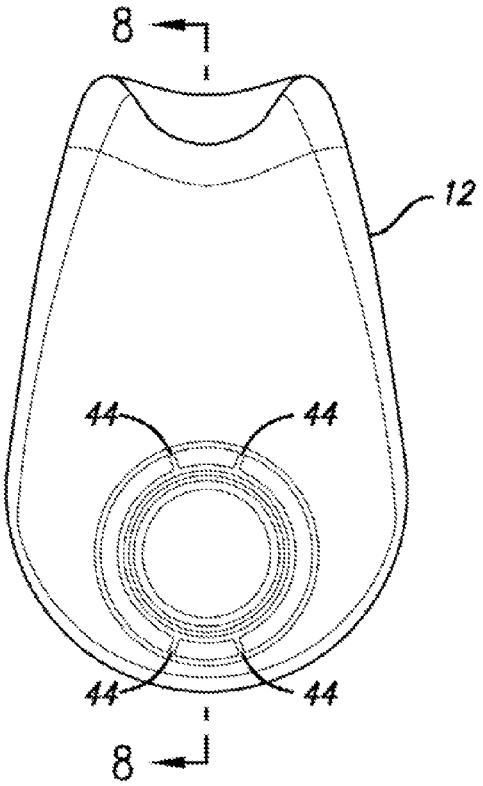
FIG. 7 is a back view of the upper portion of the beach chair of FIG. 1.
Figure 8:
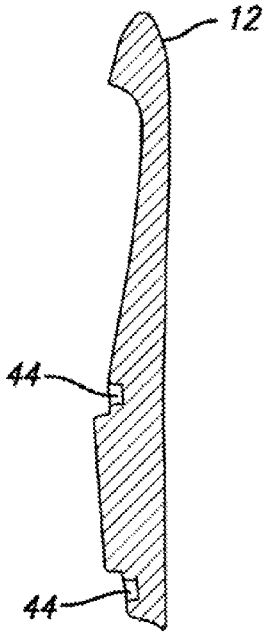
FIG. 8 is a sectional view, taken along the line 8-8, of the upper portion of the beach chair, as shown in FIG. 7.
Figure 9:
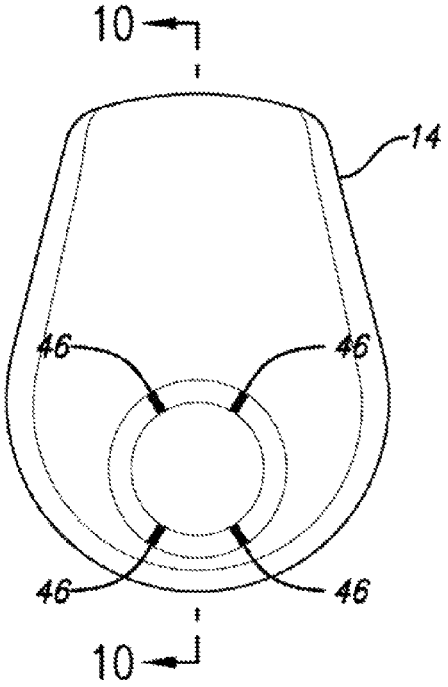
FIG. 9 is a front view of the lower portion of the beach chair of FIG. 1.
Figure 10:
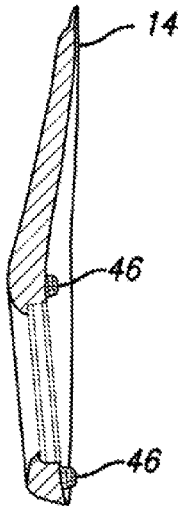
FIG. 10 is a sectional view, taken along the line 10-10, of the lower portion of the beach chair, as shown in FIG. 9.

Referring now to FIGS. 7 and 8, the beach chair 10 of the present invention includes a locking feature that allows the chair to be locked in its open and closed positions. The open position is depicted in FIGS. 1-2 and 4-5. The closed position is depicted in FIG. 6. The locking means is comprised of at least one pair of mutually opposed detents 44 spaced about one of the hub openings and at least one protrusion 46 which mates with the detents 44.

In the exemplary embodiment, two mutually opposed pairs of detents 44 are thrilled into a back side of the seatback portion 12. Two mutually opposed pairs of protrusions 46 are formed on a front side of the sand engaging portion 14. When the seatback portion 12 and the sand engaging portion 14 are interconnected by ultrasonically welding the hub rings 18 and 20 together to form the hub 16, the detents 44 and protrusions 46 are spaced such that the protrusions 46 snap into the detents 44 when the seatback portion 12 and sand engaging portion 14 are rotated into their open and closed positions, respectively.

Figure 13:
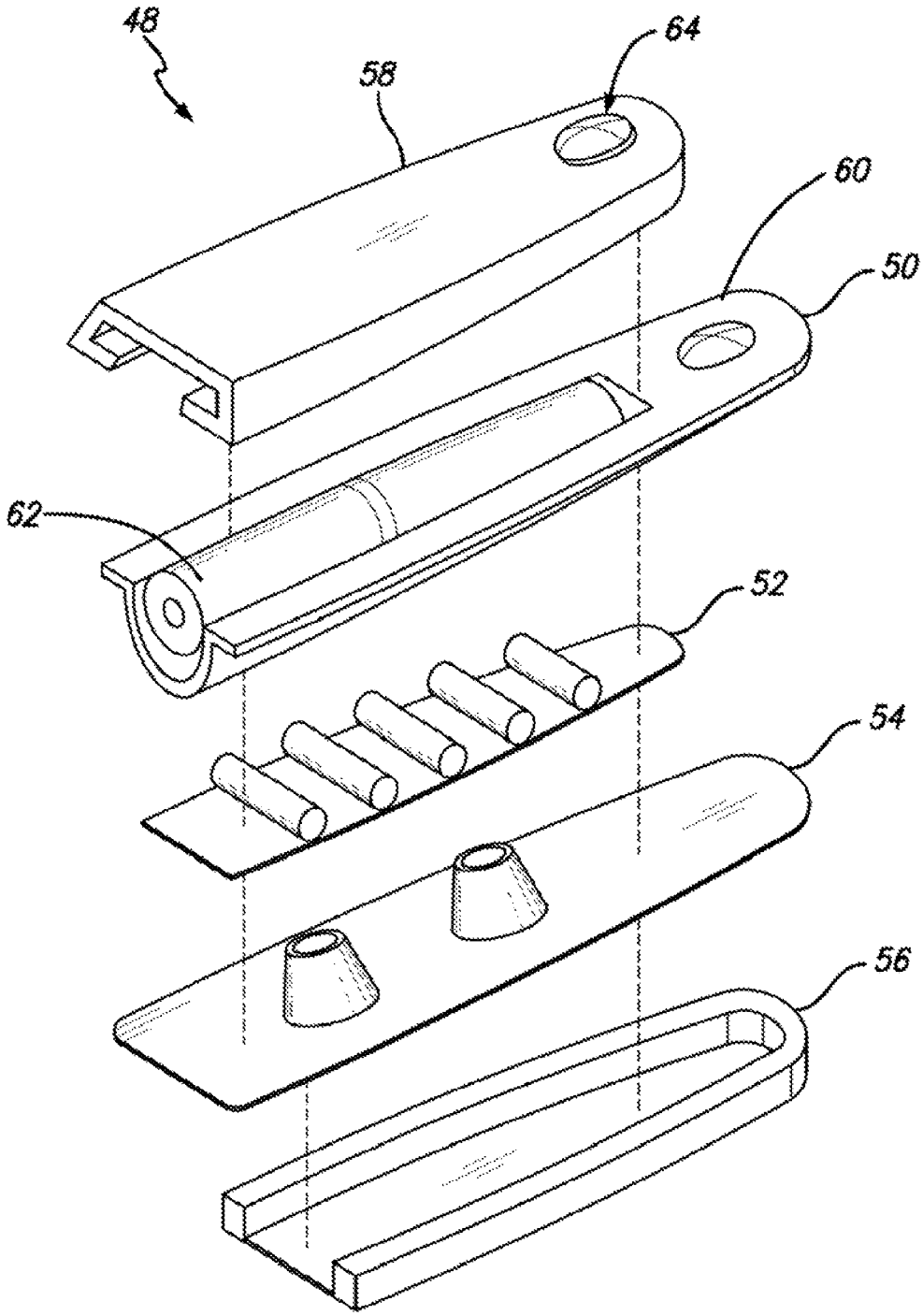
FIG. 13 is a schematic, view of a light bar suitable for use with the beach chair of FIG. 1.

With reference to FIGS. 1 and 13, the beach chair 10 of the present invention may optionally be equipped with a light bar 48 or other lighting arrangement on a back side 64 of the seatback portion 12. One suitable arrangement is shown in FIG. 13. The light bar 48 may comprise a series of light emitting diodes ("LED") 52 arranged approximately parallel to the back side of seatback 12 and held in a carrier 52 which may include replaceable batteries 62 and an on/off switch 60. The on/off switch 60 may also include a flashing mode. The carrier 50 may be affixed to a base 54 which ma be attached to the seatback 12 via mechanical fasteners, structural adhesives or the like. Covering the carrier 50 and base 54 is a snap on cover 58 which may include a tactile membrane 64 over the on/oft switch 60. The light bar assembly may be covered around its perimeter by a decorative cover 56.

In the exemplary embodiment of the present invention beach chair 10, the seatback portion 12 and the sand engagement portion 14 are made of high density polyethylene. The first and second hub rings 18 and 20 which form the hub 16 are made from ABS plastic. All of the plastic components are coated with a ultra violet ("UV") blocking polymer coating. Numerous other plastic materials are also suitable for constructing the invention and are known to those of skill in the art. The invention could also be made from aluminum or other metallic materials and could even be made from wood.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

What is claimed is:

1. A beach chair comprising:

a seatback portion;

a sand engagement portion;

a hub, wherein the hub rotatably connects the seatback portion and the sand engagement portion;

wherein the sand engagement portion has a front side and a back side, the back side having a scalloped portion, whereby the scalloped portion aids in anchoring the sand engagement portion at least partially below the plane of the sand; and wherein the front side of the sand engagement portion is of convex curvature.

2. A beach chair comprising:

a seatback portion, the seatback portion having a front side and a back side, wherein the front side is inwardly curving;

a sand engagement portion, the sand engagement portion having a front side and a back side, wherein the backside has a scalloped portion for anchoring the sand engagement portion at least partially below the plane of the sand;

a hub, wherein the hub is hollow and rotatably connects the seatback portion and the sand engagement portion; and wherein the seatback portion and sand engagement portion are rotatable between an open position and a closed position.

3. The beach chair of claim 2, wherein the inward curvature of the front side of the seatback portion is concave.

4. The beach chair of claim 2, wherein one of the rotatable portions includes at least one pair of mutually opposed detents and another of the rotatable portions includes at least one protrusion for engaging the detents.

5. The beach chair of claim 2, wherein the seatback portion includes an inwardly curved upper edge portion, wherein the upper edge portion serves to cradle a user's neck and head in a comfortable ergonomic position.

6. The beach chair of claim 5, wherein the upper edge portion of the seatback portion rolls over a back side of the seatback portion to form a handle portion.

7. A beach chair comprising:

a seatback portion, the seatback portion having a front side and a back side, wherein the front side is inwardly curving;

a sand engagement portion, the sand engagement portion having a front side and a back side, wherein the backside has a scalloped portion;

first and second hub rings which are interconnected to form a hollow hub, wherein the hub rotatably connects the seatback portion and the sand engagement portion;

wherein the seatback portion and sand engagement portion are rotatable between an open position and a closed position; and wherein one of the rotatable portions includes at least one pair of mutually opposed detents and another of the rotatable portions includes at least one protrusion for engaging the detents.

8. The beach chair of claim 7, further including a light bar affixed to the back side of the seat back portion.

* * * * *